US005368004A

United States Patent [19]

Mann

[11] Patent Number: 5,368,004

[45] Date of Patent: Nov. 29, 1994

[54] AUTOMOBILE SUPERCHARGER UTILIZING FLYWHEEL

[76] Inventor: Leslie Mann, 8111 E. Broadway, Apt. 468, Tucson, Ariz. 85710

[21] Appl. No.: 196,562

[22] Filed: Feb. 15, 1994

[51] Int. Cl.[5] ..... F02B 33/40

[52] U.S. Cl. ..... 123/559.1

[58] Field of Search ..... 123/559.1

[56] References Cited

U.S. PATENT DOCUMENTS

| | | | |
|---|---|---|---|
| 1,875,444 | 9/1932 | Hall | 123/559.1 |
| 1,901,381 | 3/1933 | Smith | 123/559.1 X |
| 4,887,580 | 12/1989 | Hilfiker . | |
| 4,896,734 | 1/1990 | Horiuchi . | |
| 5,060,622 | 10/1991 | Suzuki . | |
| 5,168,773 | 12/1992 | Janiszewski . | |
| 5,197,252 | 3/1993 | Haikawa . | |

FOREIGN PATENT DOCUMENTS

| | | | |
|---|---|---|---|
| 141777 | 5/1935 | Austria | 123/559.1 |
| 427266 | 4/1935 | United Kingdom | 123/559.1 |

*Primary Examiner*—Michael Koczo

*Attorney, Agent, or Firm*—J. Michael McClanahan

[57] ABSTRACT

A supercharger for automotive engines utilizing the automobile flywheel as a part of the air compressor means is disclosed wherein air compression type vanes are attached to the flywheel. A donut shaped plenum encompasses the flywheel with the attached vanes, the donut shaped plenum open at its inner peripheral opening to receive air proximate the driveshaft to which the flywheel is attached. The vanes on the flywheel compress the air as the flywheel rotates and deliver the compressed air via an output conduit to the automobile carburetor or to the intake manifold of the engine where it is mixed with gasoline for insertion in the cylinders.

7 Claims, 2 Drawing Sheets

AUTOMOBILE SUPERCHARGER UTILIZING FLYWHEEL

BACKGROUND OF THE INVENTION

1. Field of the Invention

The field of the invention is superchargers used on automobiles engines which also have flywheels connected to the crankshaft of the engine.

2. Description of the Related Art

In recent years, there has been a surge of interest in superchargers for automobile engines, especially in the consumer area. Automobile superchargers which deliver air to the engine for mixture with gasoline have fallen into two broad classes, the first and original type being that which derives energy for compressing the air from the engine crank shaft. The second type of supercharger, which draws on recent high temperature technology, places a turbine in the exhaust of the automobile engine as a source of energy to drive an air compressor, and is usually termed a turbosupercharger. With either type, a larger than usual amount of air is delivered to the automobile carburetor (or to the intake manifold for a fuel injection system) and ultimately to the cylinders.

An example of the first type of supercharger is illustrated in the U.S. Pat. No. 4,887,580, to Hilfiker, wherein a rotor in a round chamber employs slidable vanes to make contact with the interior periphery of the chamber. As the rotor rotates, air is drawn in and then expelled in the process of being pressurized. The device of Hilfiker is so constructed as to make use of the supercharger selectable. When the supercharger is not being used and when the automobile engine is idling, the rotor is situated at the center of the round chamber. By such means, air drawn into and discharged by the supercharger is not compressed, or if compressed, then compressed very little. However, when the supercharger is operating fully, the rotor is moved off center to an eccentric position so that more air enters the chamber whereupon the slideable vanes in the rotor compress the air and discharge it into the automobile cylinders. The rotor of the supercharger is driven by the engine crank shaft.

A second patent of the first type is shown in the U.S. Pat. No. 4,896,734, to Horiuchi, wherein a supercharger having an air compressor of somewhat conventional design is driven off the engine flywheel. The supercharger is, however, a separate device apart from the engine and receives its rotational energy by means of pulleys and belts, one pulley being the engine flywheel.

A third patent of the first type is illustrated by the U.S. Pat. No. 5,060,622, to Suzuki, where again the supercharger is a separate device situated above the transmission of the automobile and having an air compressor driven by a belt trained around a sprocket fixed to the transmission. As a result, the supercharger operates only when the clutch of the automobile is engaged.

The second type of supercharger, as referenced above, places the high temperature turbine, such as one having blades made with ceramics or high temperature steel, directly in the path of the engine exhaust gases. The central shaft of this turbosupercharger is connected to a conventional type air compressor which compresses the air prior to entrance into the engine carburetor or intake manifold.

As the present art stands, available superchargers are quite expensive and rather complicated to manufacture. As a consequence, if means and methods could be found to utilize present existing elements of an automobile engine and power train following the engine to construct the supercharger, the expense of superchargers may be reduced considerably. It is to this end that the subject invention is directed.

SUMMARY OF THE INVENTION

The embodiment of the invention described consists of a supercharger for an automobile engine utilizing the flywheel of the engine as means to compress the air and deliver the compressed air to the cylinders.

More particularly, the subject invention installs air compressing type vanes upon one of the two circular faces of the automobile flywheel. A first donut shaped annular plenum is located proximate the engine block to receive intake air into its interior by one or more entrance openings, the openings to the plenum having a tubular conduit attached thereto. Prior to entrance of air into the intake conduit and into the first intake annular plenum, an air filter may be installed. Next, a donut shaped plenum constructed from sheet metal encompassing the portion of the flywheel with the vanes attached is installed, also encircling the driveshaft protruding from the automobile engine. Both plenums are situated between the engine block and the flywheel.

The intake annular plenum is constructed such that it is open at its inner circular periphery so that air which enters the plenum exits the immediate area surrounding the engine driveshaft.

Then, the intake air exiting the intake plenum at its inner periphery enters an inner peripheral opening of the output or second plenum. The output plenum, which is somewhat similar in construction to the intake plenum in that it is also a donut shaped annular plenum is situated immediately next to the intake annular plenum. Interiorly to the output plenum, the flywheel with the attached vanes rotates. In the preferred embodiment, the annular shaped sides of the output plenum are in close proximity to the tops of the vanes attached to the flywheel. Further, the part of each vane attached to the flywheel circular face nearest the driveshaft is greatest in width so that as the air incoming from the intake plenum is gathered by this end of the vane, it is thrown radially outward along the narrowing width of the vane and thereby gradually compressed until it reaches the outer peripheral side of the output plenum. In the preferred embodiment, the vanes were somewhat pyramidal in shape although this is one of several acceptable shapes. The vanes are preferably attached to the flywheel by welding although the flywheel and vanes could be manufactured as a single element.

Continuing, a preferably single opening in the plenum outer peripheral side permits the compressed air to exit and travel through a tubular output conduit to the carburetor of the automobile (or intake manifold of fuel injected engines). There it is mixed with gasoline to enter the cylinders of the vehicle engine.

At the center opening of both the intake plenum and the output plenum, the two adjacent edges of the sheet metal plenums are joined by an annular "C" shaped band or ring so that air may not escape radially from between the two annular plenums.

The invention is useful in all internal combustion engines driving vehicles having flywheels, whether or not a manual transmission clutch engages the circular face of the flywheel opposite the vanes, or whether the driveshaft continues beyond the flywheel to an automatic transmission. Modification to the engine driveshaft and immediate area may be needed to be made to increase the space between the block of the engine and the flywheel to accommodate the inserted intake and output plenums although an alternate embodiment utilizes only an output plenum.

Due to the construction of the air compressor portion of the subject supercharger, greatest delivery of air will be accomplished when the engine is running at its highest speed.

Accordingly, it is an object of the subject invention to provide a supercharger for an automobile engine where the engine performance may be enhanced if air for combustion is delivered under pressure.

It is another object of the subject invention to provide a supercharger for an automobile engine which is relatively inexpensively constructed and which utilizes as its air compressing means elements of the automobile already present.

It is still another object of the subject invention to provide a supercharger for an automobile engine whereby the air compressing means consist of vanes attached to the existing automobile flywheel operating within an air chamber.

Other objects of the invention will in part be obvious and will in part appear hereinafter. The invention accordingly comprises the apparatus possessing the construction, combination of elements, and arrangement of parts which are exemplified in the following detailed disclosure and the scope of the application which will be indicated in the claims.

BRIEF DESCRIPTION OF THE DRAWINGS

For further understanding of the features and objects of the subject invention, reference should be had to the following detailed description taken in connection with the accompanying drawings wherein.

In various views like index numbers refer to like elements.

DETAILED DESCRIPTION OF THE PREFERRED EMBODIMENT

Figure 1:
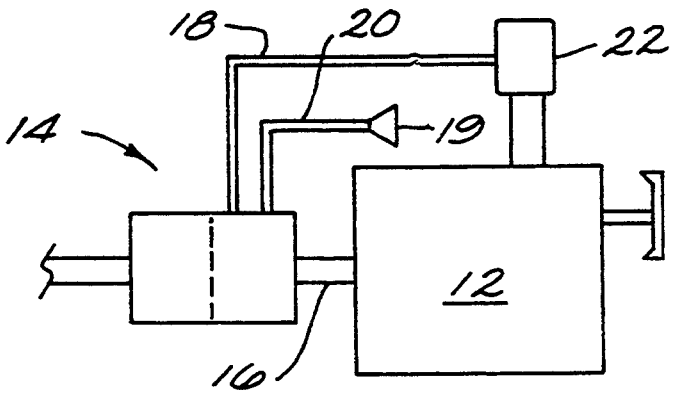
FIG. 1 is a block schematic diagram of the subject invention in place on an automobile engine.

Referring now to FIG. 1, a block schematic diagram is shown setting out the invention in operation on an internal combustion engine, preferably a gasoline driven automobile engine. Shown in FIG. 1 is automobile engine 12 connecting to flywheel-clutch assembly 14 by means of driveshaft 16. Emerging from flywheel-clutch assembly 14 are a pair of air pipes or conduits for the purpose of conducting air to and from the invention, the first being input or intake air conduit 20. Attached to the distal end of intake conduit 20 is air filter 19, filter 19 adapted to remove large air-borne particles from the air. Secondly emerging from flywheel-clutch assembly 14 is output air conduit 18, conduit 18 connecting at its opposite end to carburetor 22.

The subject automobile supercharger utilizing the automobile flywheel to receive input air via conduit 20 compresses that air by means of a vane type rotary air compressor, and transmits the received and compressed air to carburetor 22 by means of conduit 18. The compressed air which is supplied to carburetor 22 is mixed with gasoline causing the gasoline to vaporize and then the vaporized gasoline is forced into the cylinders of automobile engine 12 under the pressure generated by the supercharger. In the case of an automobile engine with a fuel injection system, a carburetor is not used and the compressed air is delivered to the intake manifold proximate the cylinder valves where it mixes with sprayed gasoline to achieve vaporization.

Figure 2:
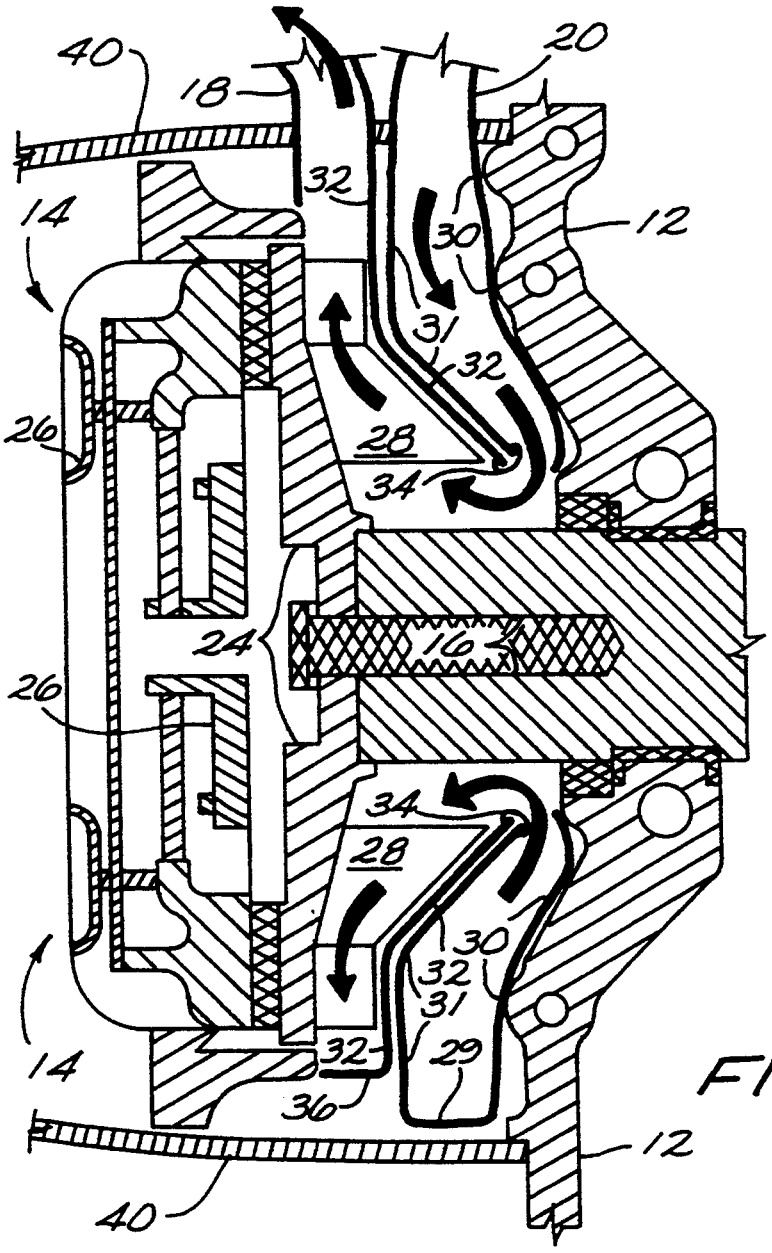
FIG. 2 is a cross-sectional view of the invention in place situated around the automobile driveshaft and utilizing the automobile flywheel.

Referring next to FIG. 2, a cross-sectional view is shown of the invention together with a portion of automobile engine 12 and connected flywheel-clutch assembly 14 together with the intake and output air conduits 20 and 18 respectively. In respect of the portion of automobile engine 12 shown in FIG. 2, the drawing is taken about the crank shaft emanating from engine 12 which becomes driveshaft 16, with flywheel 24 being mounted directly to it. Flywheel 24, as is well known in the art, is a round disk having two circular faces, one of which is a smooth planar face and has teeth situated at its annular periphery for engagement by a starter motor shaft gear (not shown). Pressing firmly against the flat smooth face of flywheel 24 is clutch and pressure plate assembly 26, a pressure plate urging the clutch up against flywheel 24 when it is desired to transmit the rotary motion of driveshaft 16 to the clutch (and the drive train assembly following it which is not shown). Actual engagement between the flywheel and the clutch usually takes the form of an annular segmented pad attached to the clutch plate. All this is well known in the automotive art.

The invention is shown in the addition of air compressing type vanes 28 to the outer peripheral portion of the second circular face of flywheel 24, that face used being opposite the face engaged by the clutch. As flywheel 24 rotates these vanes compress the air to deliver the air under pressure to the carburetor via output air conduit 18.

More particularly, shown in FIG. 2, outside air enters the invention through intake air conduit 20 into a donut shaped intake plenum formed by forward or front wail 30, rear wall 31 and outer peripheral wall 29. In the preferred embodiment, the intake plenum encircles driveshaft 16 and has one or more openings through outer peripheral wall 29 for incoming air, such as the opening connecting with input air conduit 20. Front or forward side 30 of the plenum resides against the rear wall of engine 12. Air incoming through conduit 20 enters the intake plenum and approaches the center area of the plenum. It exits the intake plenum through the open inner periphery of the annular plenum and makes nearly a complete reverse turn to enter the open inner periphery of the output plenum formed of forward wall 32 and outer peripheral wall 36.

The output plenum is also donut shaped and has one of its annular shaped sides Juxtaposed the annular shaped side of intake plenum. The output plenum also encircles driveshaft 16 and has only one outlet, namely an opening through the outer peripheral wall 36 which connects with output conduit 18. The inner peripheral edge of the inner openings of wall 31 of the intake plenum and wall 32 of the output plenum are held together by annular "C" clamp and band 34, which also serves to prevent the escape of air radially from between the two plenums.

Outer peripheral wall 36 and the rear portion of output conduit 18 do not touch pressure plate and clutch assembly 26, but approaches it very closely. This is necessary because the output plenum is stationary while the pressure plate and clutch assembly 26 rotate. Since air which is interiorly to the output plenum is under pressure, there may be an air leak at this point. A seal interposed outer peripheral wall 36 and pressure plate and clutch assembly 26 may be employed, although not shown.

As the air moves from the intake conduit 20 into the intake plenum, it continues to the central circular opening where it exits to the central circular opening of the output plenum. As flywheel 24 rotates, vanes 28 engage this incoming air from the intake plenum to deliver it to the periphery of the flywheel. The air exits the output plenum through an opening and into output conduit 18 which conducts the air to the carburetor. As the air is initially engaged by the portion of vanes 28 nearest the interior opening of the output plenum, it is thrown circularly outward by rotating vanes 28, compressing the air, and forcing the air to exit under pressure into output conduit 18.

In the preferred embodiment of FIG. 2, vanes 28 conform closely to the interior shape of the output plenum housing, so that there is very little clearance between the vanes and the inside surface of the plenum housing. In addition appropriate sealing means may be employed to assure that little, if any, air should escape between the vanes whereby all of the air interiorly to the output plenum should be exhausted through the output conduit 18. One possible method of sealing is to place a strip of sealing material, such as neophrine, on the top edge of each vane, the neophrine seal contacting and sliding upon the inside surface of the output plenum housing.

As the automobile engine accelerates, flywheel 24 also responds in increased angular velocity and as the carburetor is demanding more air from the supercharger, more air is supplied.

Also shown in FIG. 2 is bell housing 40, well known in the automobile art, which connects with engine 12 and surrounds pressure plate and clutch assembly 26 as well as flywheel 24. As bell housing 40 continues to the rear of the automobile (to the left in FIG. 2), it links up with the transmission (not shown). The subject invention is contained within bell housing 40 with two openings through the housing to accommodate the intake and output air conduits 20 and 18 respectively.

Figure 3:
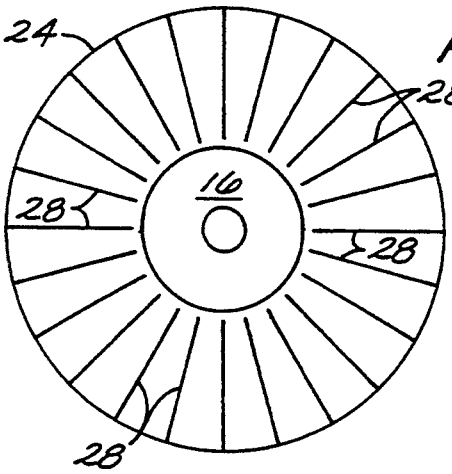
FIG. 3 is a top view of the automobile flywheel with a plurality of vanes attached thereto.

Referring now to FIG. 3, a top view of flywheel 24 is shown illustrating the placement of the radially oriented multiple vanes 28. Centrally located in FIG. 3 is driveshaft 16. Vanes 28, which may be constructed of a metal such as steel or aluminum, are attached to flywheel 24 by welding, or as mentioned before, the flywheel may be initially formed with the vanes in place.

Figure 4:
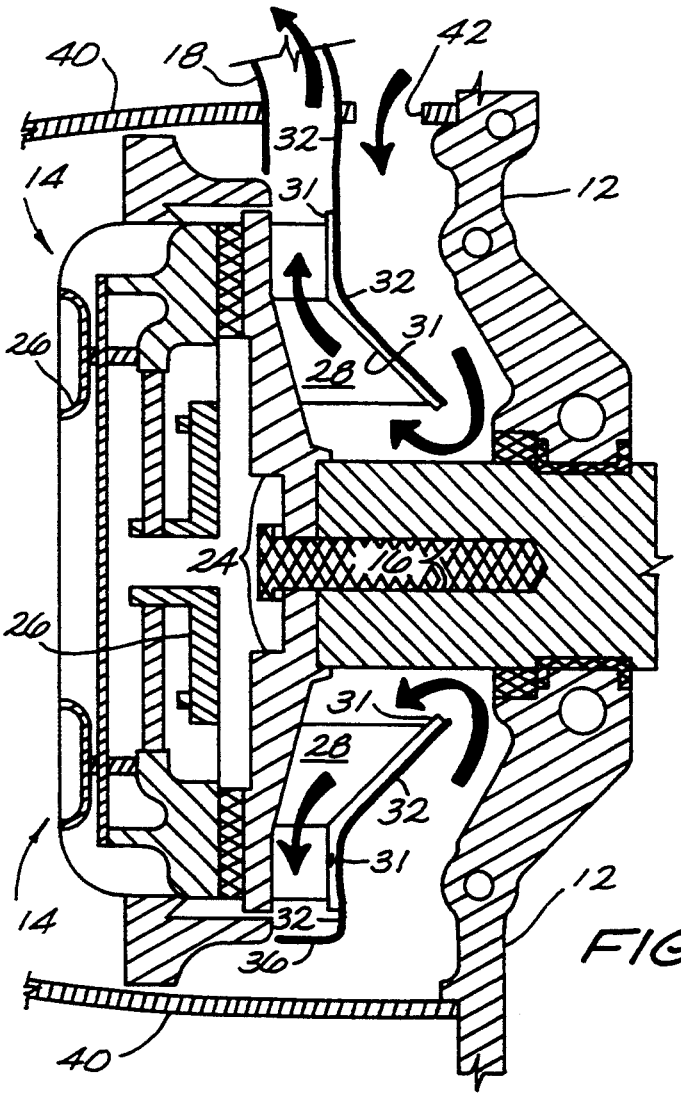
FIG. 4 is a cross-sectional view of an alternate embodiment of the invention.

Lastly, referring now to FIG. 4, an alternate embodiment of the invention is disclosed wherein the intake plenum has been removed, leaving the output plenum together with the flywheel and its attached vanes. More particularly, in FIG. 4, the output plenum with its front facing wall 32, outer peripheral wall 36 and connecting output conduit 18 are shown situated as it was in the preferred embodiment of FIG. 2. Air, now entering bell housing 40 through one or more openings 42, proceeds to the center area of bell housing 40 where it enters the inner circular opening of the output plenum. There the air is engaged by vanes 28 attached to flywheel 24, vanes 28 operating within output housing 32 in a sealed manner such as was described in connection with FIG. 2. An example of such a seal is shown in FIG. 4 by neophrine strip 31 attached to the top edge of vanes 28. As in the preferred embodiment, the incoming air is thrown in a radially outward circularly fashion to the outside periphery of flywheel 24 where it is compressed and from where it exits the output plenum by means of connecting output conduit 18. As before, output conduit 18 connects with the engine carburetor.

While an advantage of the alternate embodiment is that it requires fewer elements, namely the absence of the intake plenum, yet in the embodiment shown, the intake air is not filtered. Of course, a filter could be mounted over opening 42 in bell housing 40.

Figure 5:
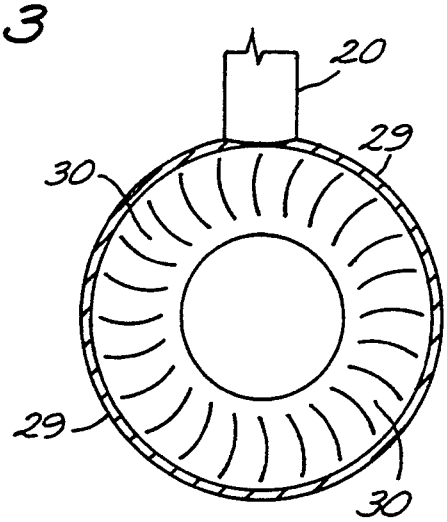
FIG. 5 is a top view of the intake plenum separated from the automobile engine.
Figure 6:
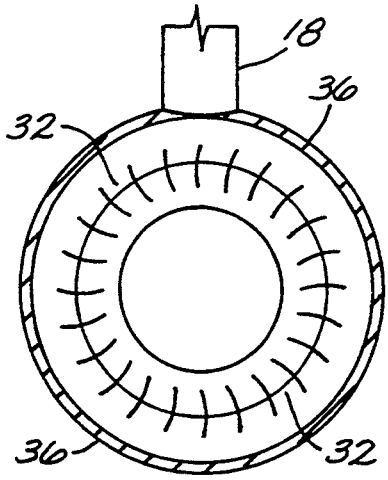
FIG. 6 is a top view of the output plenum separated also from the engine.

For added clarity, a top or front view of the intake plenum separated from the automobile engine is shown in FIG. 5 and a top or front view of the output plenum also separated from the engine is shown in FIG. 6. More specifically in FIG. 5, the intake plenum housing front wall 30 is shown as well as the circularly shaped outer peripheral wall 29 attached to front wall 30. Not shown but situated immediately below front wall 30 is the rear wall 31 of the plenum housing. Central to the annularly shaped intake plenum is the opening through which the crank shaft of the engine extends and which permits air to exit the intake plenum and enter the output plenum next discussed. Lastly, connected to the plenum housing shown in FIG. 5 is the input air conduit 20.

Next, the annular output plenum is shown in FIG. 6 in a top view removed from its position encompassing the vanes and the flywheel. Here, top or front wall 32 is shown, joining with the outer peripheral wall 36. Central to the annular plenum is the opening through which the crank shaft of the engine extends, and through which air enters the plenum to be engaged by the rotating vanes attached to the flywheel. Lastly, as was the case with the intake plenum housing, means are provided to remove the compressed air from the plenum, namely through output conduit 18.

While a preferred embodiment of the invention has been shown and described, together with an alternate embodiment, it will be appreciated that there is no intent to limit the invention by such disclosure. Accordingly, the disclosure is intended to cover all modifications and alternate embodiments falling within the spirit and the scope of the invention as defined in the appended claims.

I claim:

1. A supercharger for internal combustion engines of the type having a carburetor, intake manifold, crankshaft, and a flywheel attached to the engine crankshaft, said supercharger operably utilizing the automobile flywheel for supplying compressed air to the carburetor and intake manifold, said supercharger comprising:

air compression vanes operably attached to said flywheel;

an annularly shaped output plenum housing encompassing in part said vanes attached to said flywheel, said output plenum housing having a circularly shaped outer periphery wall, said output plenum housing including an inlet opening located centrally in said annularly shaped output plenum housing to allow air to enter said output plenum housing for compression by said vanes and an output opening situated in said outer peripheral wall to allow air to exit said output plenum housing after compression; and an annularly shaped intake plenum housing proximate said output plenum housing, said intake plenum housing having a circularly shaped outer peripheral wall, said intake plenum including an inlet opening situated in said outer peripheral wall to allow air to enter said plenum and an outlet opening located centrally in said annularly shaped output plenum housing to allow air to exit said plenum; and means to deliver the air so compressed to the carburetor and intake manifold for use by the engine.

2. The supercharger for engines as defined in claim 1 wherein said centrally located inlet opening in said output plenum housing and said centrally located outlet opening in said intake plenum housing circularly surround the engine crankshaft, and said intake plenum housing outlet opening is proximate said output plenum housing inlet opening such that air exiting said intake plenum housing enters said output plenum housing.

3. The supercharger for engines as defined in claim 2 wherein said means to deliver the air so compressed to the carburetor and intake manifold includes an output air passage tube having two ends, one end of which is operably attached to the output plenum housing outlet opening, the other end operably attached to said carburetor and said intake manifold.

4. The supercharger for engines as defined in claim 3 wherein said means to gather air for delivery to said output plenum housing for compression includes an intake air passage tube having two ends, the first end of which is operably attached to said intake plenum housing inlet opening and the second end of which is open to air proximate the engine.

5. The supercharger for engines as defined in claim 4 further including an air filter, said air filter operably attached to said second end of said intake air passage tube whereby air entering said intake air passage tube must first pass through said air filter.

6. The supercharger for engines as defined in claim 5 wherein said vanes which are attached to said flywheel are in close proximity said output plenum housing and further including air seals, said air seals operably attached to said air compression vanes, said air seals interposed between said compression vanes and said output plenum housing, said air seals preventing air from leaking between said air compression vanes.

7. The supercharger for engines as defined in claim 6 further including a securing ring, said securing ring encompassing said centrally located outlet opening of said intake plenum housing and said centrally located inlet opening of said output plenum housing to secure said intake plenum housing to said output plenum housing and to prevent air leakage between said intake plenum housing and said output plenum housing.

* * * * *